United States Patent [19]

Riblet

[11] 4,103,856

[45] Aug. 1, 1978

[54] ADJUSTABLE SCAFFOLD BRACKET

[76] Inventor: Henry Riblet, 87 Crescent Rd., Needham, Mass. 02194

[21] Appl. No.: 706,376

[22] Filed: Jul. 19, 1976

Related U.S. Application Data

[63] Continuation-in-part of Ser. No. 514,583, Oct. 15, 1974, Pat. No. 3,970,277.

[51] Int. Cl.[2] ..... A47B 47/00

[52] U.S. Cl. ..... 248/246; 182/133

[58] Field of Search ..... 248/246, 125, 221; 182/136, 133, 101; 254/29 R

[56] References Cited

U.S. PATENT DOCUMENTS

| | | | |
|---|---|---|---|
| 755,809 | 3/1904 | Stoolfire | 182/136 |
| 1,416,296 | 5/1922 | Hoitsma | 182/136 |
| 1,441,806 | 1/1923 | Hoitsma | 182/136 |
| 1,516,564 | 11/1924 | Barthelemy et al. | 182/136 X |
| 1,731,052 | 10/1929 | Laborda | 182/136 X |
| 2,038,899 | 4/1936 | Hoitsma | 182/136 X |
| 2,216,912 | 10/1940 | Hoitsma | 182/136 |
| 2,240,682 | 5/1941 | Weinstein | 182/136 |
| 2,342,427 | 2/1944 | Riblet | 248/246 |
| 3,473,774 | 10/1969 | Riblet | 248/246 |
| 3,880,256 | 4/1975 | Couris | 182/136 |
| 3,970,277 | 7/1976 | Riblet | 248/246 |

FOREIGN PATENT DOCUMENTS

| | | | |
|---|---|---|---|
| 778,528 | 1/1956 | United Kingdom | 182/133 |

*Primary Examiner*—J. Franklin Foss
*Attorney, Agent, or Firm*—Charles L. Lovercheck

[57] ABSTRACT

A plurality of scaffolds stacked one above the other on a support and each scaffold supported on two laterally spaced self-locking scaffold brackets attached to the supports by load-activated locks. A hoisting mechanism is selectively connected to the scaffolds in such a way as to lift each of the scaffolds up sequentially into its final position. Mechanical jacks connected to the load activated locks are used for final small adjustment of the positions of the scaffolds. The jacks are disabled without removing them during the time that the scaffolds are being moved up or down.

28 Claims, 14 Drawing Figures

ADJUSTABLE SCAFFOLD BRACKET

REFERENCE TO PRIOR ART

This is a continuation-in-part of Patent Application Ser. No. 514,583 filed Oct. 15, 1974 now U.S. Pat. No. 3,970,277.

FIELD OF INVENTION

The invention relates generally to scaffolds of the type having a platform supported on brackets attached to upright posts in a manner permitting the height of the platform to be changed. More particularly, the invention pertains to an improved combination of platform supporting brackets employing load-activated locks which permit the platform to be raised safely and without appreciable lost motion by a foot-operated hoisting device or a block and tackle and a block and tackle connected to the brackets for hoisting them into approximate position in stacked relation to each other.

The parent application discusses the general practice in the employment of scaffold brackets of the type shown in U.S. Pat. No. 2,342,427 to span a pair of spaced uprights with a platform supported upon brackets that are secured to the uprights. The parent application discloses a foot-operated hoist mechanism which permits workmen on a bracket-supported scaffold to raise the platform. The foot-operated hoisting mechanism obtains its lifting force by having the operator exerts his weight on a lever by stepping into a stirrup. The foot-operated hoisting mechanism of the prior art is not intended to be used in conjunction with a platform bracket using a load-activated lock, but rather is intended for use with locks of the type employing springs to provide the force causing the jaw of the lock to re-engage the uprights at the end of the lifting stroke. The parent application explains the operation of a stop member which so engages with the side plates of the lock that when the levers are raised to extreme position as shown in the drawings, the jaws of the hoisting mechanism are disengaged from the upright. In this condition, the platform support and hoisting mechanism can be raised and lowered by means of block and tackle as shown in the parent application.

OBJECTS OF THE INVENTION

It is an object of the invention to provide an improved scaffold-lifting device.

Another object of the invention is to provide a scaffold lifting device that is simple in construction, economical to manufacture and simple and efficient to use.

Another object of the invention is to provide a foot-operated hoisting device acting in combination with a scaffold bracket employing a load-activated lock with means whereby the combination may be raised and lowered by a block and tackle.

Another object of the invention is to provide a scaffold-lifting device wherein two or more scaffolds can be lifted from the ground upward by means of a hoisting mechanism.

With the above and other objects in view, the present invention consists of the combination and arrangement of parts hereinafter more fully described, illustrated in the accompanying drawing and more particularly pointed out in the appended claims, it being understood that changes may be made in the form size, proportions and minor details of construction without departing from the spirit or sacrificing any of the advantages of the invention.

GENERAL DESCRIPTION OF DRAWINGS

DETAILED DESCRIPTION OF DRAWINGS

Figure 1:
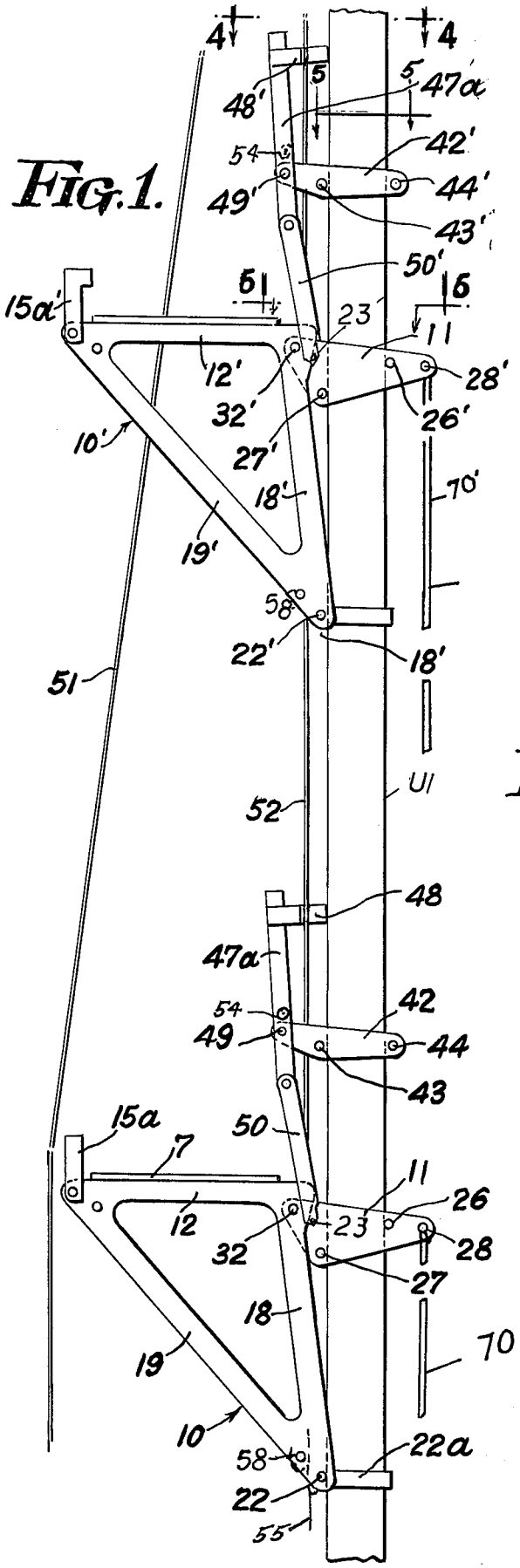
FIG. 1 is a side diagramatic view of a scaffold-supporting device with jack and hoist arrangement according to the invention.

A diagramatic side view of the platform-lifting device according to the invention is shown in FIG. 1. The hoist and brackets used are shown in more particular detail in FIGS. 2 and 3.

The brackets are supported on upright U1 and the self-activated locks are arranged to clamp the brackets on the upright. In the example shown, two brackets are shown, one above the other, indicated at 10 and 10'. The corresponding parts of the upper and lower bracket supports have similar numbers with a prime number added to the upper part numbers.

Frame 10 employs a pair of rigid, generally triangular members arranged side by side to provide rails 12 and 13.

To accomodate a wider platform, rails 12 and 13 can be lengthened by moving a pivoted member 15 A from position where it is nested with the rails 12 and 13 to a position where its rails form extensions of rails 12 and 13 as shown in the parent application. Rail 12 is part of a rigid triangular structure having legs 18 and 19 as its other sides. The two rigid, generally triangular structures 19 and 20, form the basic platform supporting frame. A rod 22 is disposed at the lower end of the frame to bear upon the face of the upright U1. A roller may be provided on the rod so that the roller can turn to permit rolling action upon the face of the upright U1, where it is desired to facilitate raising and lowering of the bracket. To hold the lower end of the rigid frame in appropriate relation to the upright, a yoke **22*a* is mounted on the rod 22**.

The platform supporting frame 10 is supported upon the lock 11 in a manner permitting the lock to pivot relative to the frame about a fulcrum "rod" 32 extending between rails 12 and 13, as described in my U.S. Pat. No. 2,342,427. The locking device employs a pair of spaced plates having an outer jaw 26 and an inner jaw 27 immovably fixed to the plates in a manner permitting the upright U1 to be received between the jaws with the plates on the opposite sides of the upright. The plates have portions extending beyond the outer jaw 26 which support an interposed bar 28. The pivotal axis formed by fulcrum rod 32 is situated in relation to outer jaw 26 so that when the upright U1 is clamped between the inner and outer jaws, the fulcrum rod 32 is even with or above the horizontal line passing through the line of contact between jaw 26 and the adjacent face of the upright U1. The inner jaw 27 is disposed below the pivotal axis and the downward oblique force exerted by the load on platform 7 upon the fulcrum 32 results in opposing force on the outer jaw 26 to cause the lock to engage the upright U1 as describe in my U.S. Pat. No. 2,342,427. Once engaged, the greater the downward oblique force on the pivotal axis, the greater is the clamping force exerted on the upright U1.

Disposed between the fulcrum rod 32 and the inner jaw 27 is a trunnion bar 23 whose end protrudes through apertures in the plate 25. The trunnion bar is preferably arranged so that it cannot rotate relative to plate 25. The introduction of the trunnion bar 23 between pivotal axis 32 and inner jaw 27 results in an improved locking action. The proper location of the trunnion can completely eliminate lost motion due to the opening of the lock on the upright when the platform causes the lock to immediately reassert its grip upon the upright. The platform, therefore, is held in place on the upright and there is no loss in height due to the opening of the lock during the hoisting operation.

By providing a trunnion axis 23 as in FIG. 1, and by placing that axis at an appropriate location between the fulcrum rod 32 and the inner jaw 27, lost motion can be so greatly minimized as to be negligible.

A pair of levers 47 and 47*a*, which are joined at one end by a stirrup 48, are mounted to pivot about an axle 49 extending between plates 41 and 42. Pivotally attached to the ends of the levers are a pair of lifting straps 50 and 51. Straps 50 and 51 have means for attaching them to the trunnion axis on the scaffold bracket.

Figure 12:
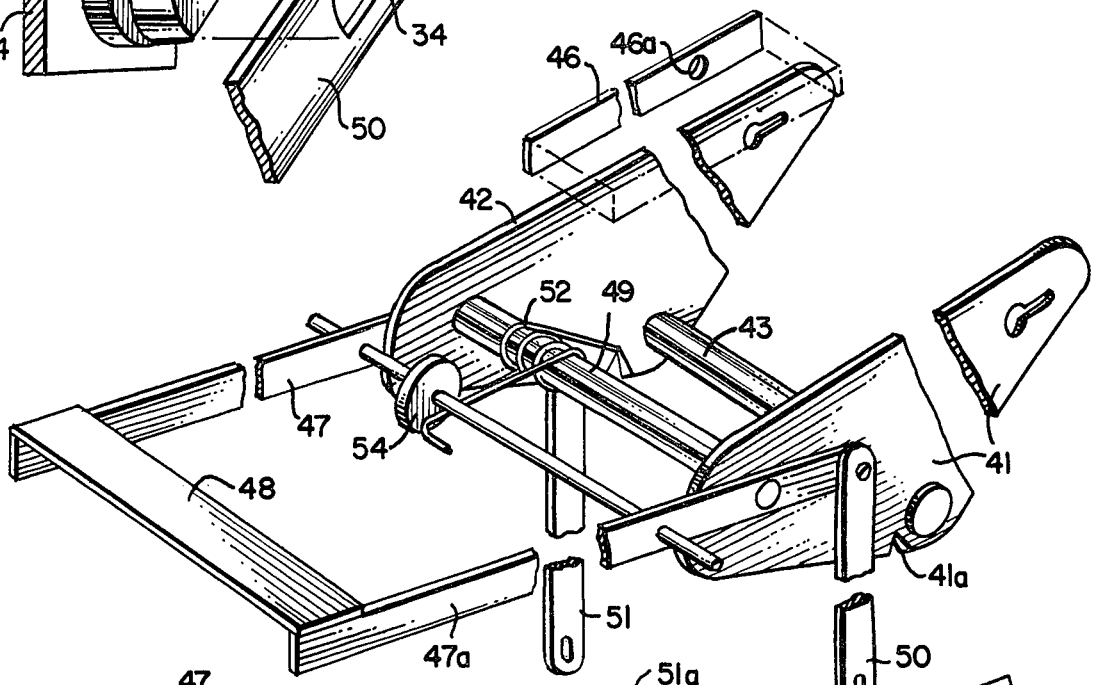
Figure 12:
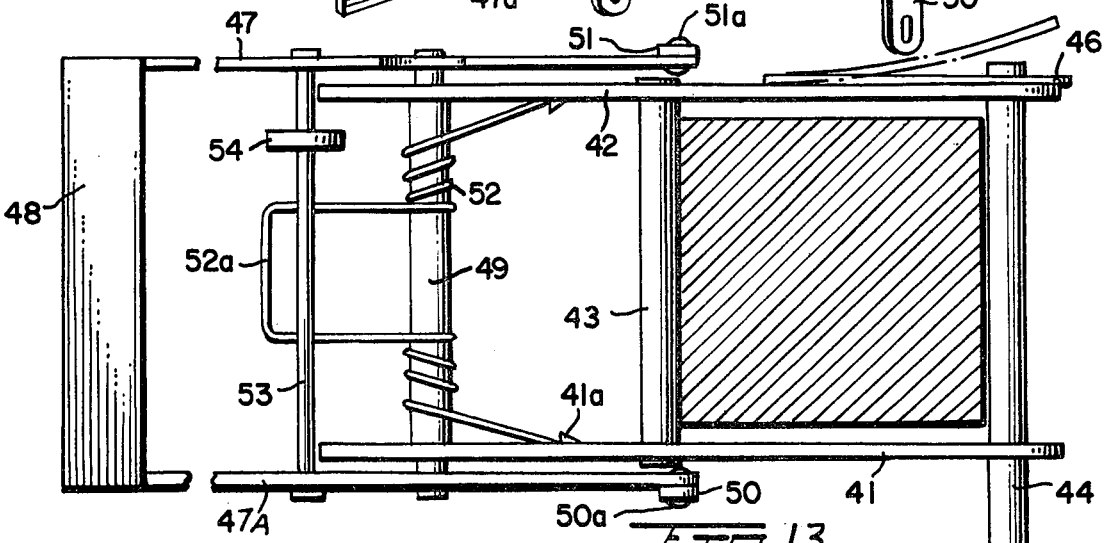
Figure 13:
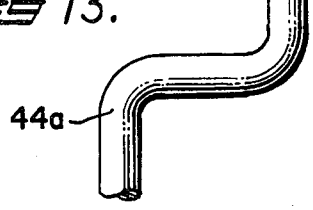
Figure 14:
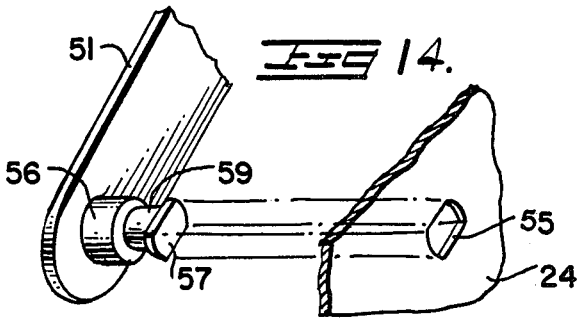

As shown in FIG. 13, disposed about the axle 49 is a spring 52 having its ends anchored upon the plates 41 and 42 and having its center loop 52*a* engaging the underside of rod 53 extending between levers 47 and 47*a*. As a matter of convenience in anchoring the ends of spring 52, each of the plates has a tab 41*a* or 42*a* bent out from the plate which is engaged by the end of the spring. The spring exerts a force on the tabs, tending to rotate the plates 41 and 42 about axle 49 in the direction which brings the outer jaw 44 upwardly against the face of the upright U1. As viewed in FIG. 3, the spring force causes the counterclockwise rotation of the plates about axle 49. If the stop member 54 of FIG. 12 is slid along on bar 53 of FIG. 13 until it is in line with the side plate 42 of the upper lock, then, when the levers 47 and 47 A are moved into the upright position shown in FIG. 1, they will transmit a force through the stop member 54 to the side plate which will disengage jaws 43 and 44 from the upright. In this condition, the scaffold bracket will be supported only by the self acting lock 11.

Figure 7:
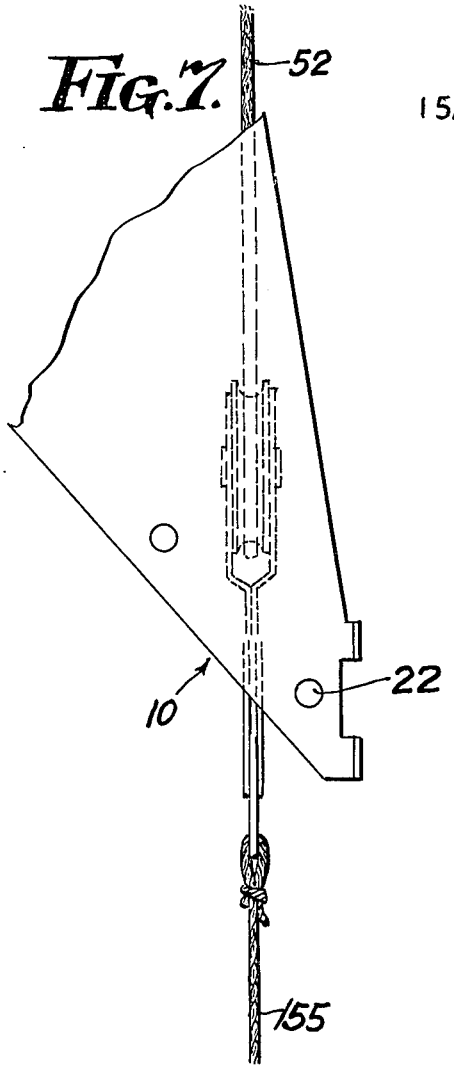
FIG. 7 is an enlarged partial view of a part of the block and tackle according to the invention.
Figure 8:
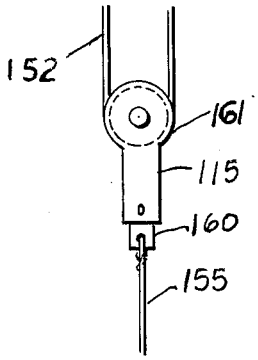
FIG. 8 is a side view of the lower block of the block and tackle according to the invention.
Figure 9:
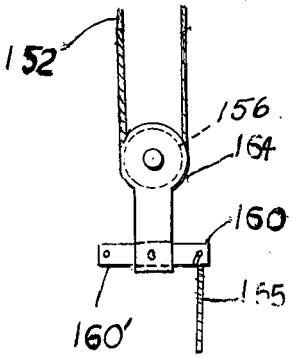
FIG. 9 is a side partial view of the lower block in a second-mode according to the invention.
Figure 10:
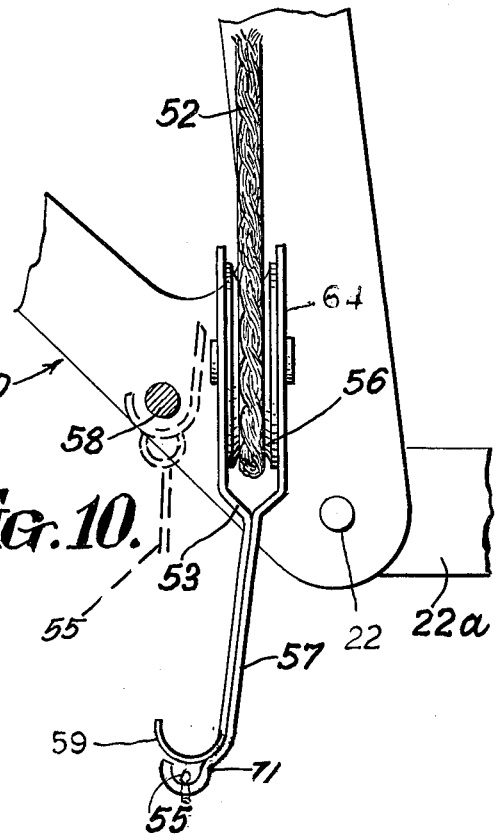
FIG. 10 is an enlarged view of another embodiment of the lower block.
Figure 11:
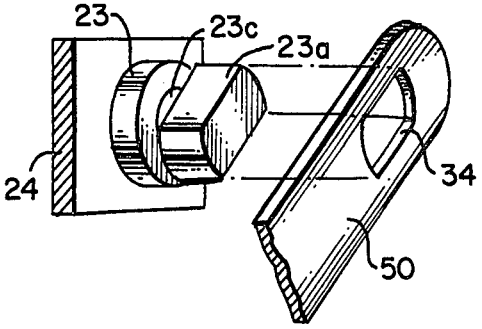
FIGS. 11–14 are detailed views of the jacking mechanism.

FIGS. 8 and 9 show an alternate arrangement of the lower block 115 of a block and tackle hoisting mechanism. The lower portion of the side members of the lower block 115 support a pivotable cross member 160 which is a gripper and can be set in a horizontal position as shown in FIG. 9 or a vertical position a shown in FIG. 8. A tie rope 155 is attached to the cross member 160 at one end. FIG. 7 shows how, with the cross member 160 set vertically, the lower block and tie rope will pass freely between two bars 22 and 58 joining the two side members 19 of the scaffold bracket. When the cross member 160 is set horizontally, on the other hand, the lower block is prevented from passing through the scaffold bracket. The same result may be accomplished in a different manner as shown in FIG. 10.

Figure 4:
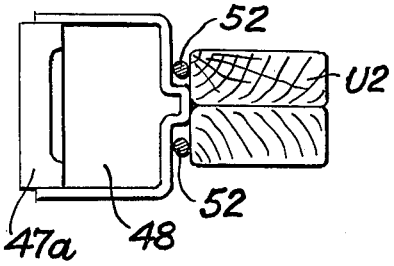
FIG. 4 is a cross-sectional view taken on line 4—4 of FIG. 1.

If the lower portions of the lower block is formed into a hook 59 which is provided with an eyelet 71 for a tie rope 55, then, it is easily seen how the hook 59, which is a gripper, can be engaged with the cross bar 58 which forms a trap for hook 59 by proper management of the tie rope in one mode of operation and arranged to pass freely through the space formed by cross rods 58, 22, and the side plates 19 in another. It is also clear from FIGS. 4–6 how the lower block with its tie rope, when set in the proper position, can pass freely through one bracket to another.

OPERATING THE HOISTING MECHANISM SHOWN

Figure 2:
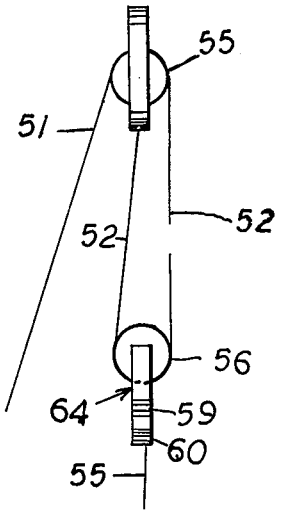
FIG. 2 is an enlarged view of the hoisting mechanism.

Assuming that all of the scaffolds are at the bottom of the supports U1, they may be hauled up into their final position, as shown in FIG. 1, by the block and tackle shown in FIG. 2. The mechanical jacks on each bracket are then used for final small adjustment of the scaffold in position. In order for the brackets and jacks to be moved up and down by the block and tackle, the jacks must be disabled by moving the levers 47A of the lower scaffold and 47A' of the upper scaffold to the position shown in FIG. 1 with the stop member 54 in position to engage the side plate 42.

The operator can then operate the hoist so that the hook 59 engages the bar 58' of the upper scaffold. The upper scaffold 10' may then be hoisted into position up along the upright U1, when it is held in place by its load-activated lock. The operator then lowers the lower block by its tie rope, engages the next lower bracket and repeats the procedure until all the brackets are in place.

To lower the scaffolds, the procedure is reversed. The operator first engages the hooks 59 under the rod 58 of the lower scaffold. Then, with the jack disabled by swinging lever 47*a* to the position shown in FIG. 1, with stop member 54 engaged, the operator exerts an upward lifting force on the hoist to take the load off the jaws 26 and 27. A downward force is then exerted on the tie rope 70 to hold the jaws 26, 27 out of engagement with the upright so that the scaffold can slide down upright U1. The operator can then lower the scaffolds 10 by means of the block and tackle, meanwhile holding the jaws 26, 27 out of engagement with the upright by means of tie rope 70. When the lower scaffold 10 has been lowered to the desired position, pull down rope 70 is released, allowing jaws 27 and 28 to support the lower platform. The lower block 115 is passed up through this scaffold bracket in a manner already explained, and the procedure is repeated on the next lower scaffold bracket which is still above ground level. It is clear that this procedure can be repeated until all the scaffold brackets are at ground level.

It is clear that the operation of my invention depends on an arrangement whereby the lower block of the hoisting mechanism can be passed by through the scaffold brackets in one mode of operation, while in another mode of operation, can be used to hoist them one at a time. FIGS. 7–10 show two alternate arrangements for doing this. It will be clear to those familiar with the art how this might be accomplished by a suitable dog or pawl attached to the scaffold bracket itself.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination,
a scaffold bracket,
an upright member,
said scaffold bracket comprising,
a platform support,
a lock means,
said platform support being attached to said lock means,
said lock means supporting said platform support on said upright,
mechanical jack means, including a jack lock, connected to said scaffold bracket for raising said bracket,
flexible hoist means connected to said scaffold bracket for raising said scaffold bracket and elongated lock disabling means attached to said lock means,
said elongated actuating member being accessible to a person below said scaffold bracket whereby a tensile force on said elongated actuating member will release said lock means from said upright member allowing said scaffold bracket to be lowered by said flexible hoist means.

2. The combination recited in claim 1 wherein the said scaffold lock means comprises,
an inner jaw and an outer jaw spaced from each other and adapted to slidably receive said upright therebetween,
said inner jaw being disposed between said connecting means and said outer jaw,
said outer jaw being disposed between said inner jaw and said scaffold lock disabling means.

3. The combination recited in claim 1 wherein said flexible hoist means comprises,
a rope hoist having a pulley at the top and a pulley at the bottom and a gripper on said lower pulley,
said gripper has a pull-down rope connected thereto and extending downwardly therefrom,
whereby said gripper can be pulled down from said scaffold bracket to a scaffold bracket supported below it on said upright member and can be brought into engagement with said scaffold bracket below said first-mentioned scaffold bracket.

4. In combination,
a scaffold bracket,
an upright member and flexible hoist means for raising said scaffold bracket on said upright member,
said scaffold bracket comprising a platform support attached to lock means supporting said platform on said upright member,
means attaching said flexible hoist means to said scaffold bracket and disabling means attached to said lock means and extending downwardly therefrom and operable at a substantial distance from said lock means whereby said scaffold member can be disabled from its connection to said upright member and said scaffold bracket and lock means can be lowered,
a gripper means on the lower portion of said flexible hoist means adapted to grip said scaffold brackets when said hoist is raised and thereby raise said scaffold bracket,
said gripper means being adapted to disengage said scaffold bracket when it is lowered,
said gripper means being adapted to freely pass below said scaffold bracket when it is lowered below said scaffold bracket.

5. The platform support recited in claim 4 wherein a gripper means on the lower end of said flexible hoist means is adapted to move between said inner lock jaw and said connecting means,
and means on said gripper means to engage a trap means when said flexible hoist means is raised and to slide down between said inner lock jaw and said connecting means when said flexible hoist means is lowered.

6. The platform support recited in claim 4 wherein said gripper means comprises,
a bar having its intermediate part connected to said hoist means and extending outwardly from each side thereof and adapted to underlie said scaffold bracket when extending perpendicular to said flexible hoist and to slide between said inner scaffold bracket jaw and said connecting means when said bar is disposed generally parallel to the direction of movement of said flexible hoist.

7. The platform support recited in claim 6 wherein an elongated flexible member is attached to said elongated bar at one end thereof,
whereby said bar can be moved from a horizontal position to a vertical position.

8. The platform support recited in claim 4 wherein said gripping means comprises a hook,
whereby said hook can be moved laterally to engage a connecting means or be moved toward said upright to move away from said connecting means and said hoist can be pulled downward away from the said scaffold bracket.

9. The combination recited in claim 4 wherein said lock means is a load activated lock.

10. In combination, a scaffold bracket and a locking mechanism, and a hoisting mechanism for use with an upright post,
said bracket being of the type employing a rigid frame for supporting a platform and a lock having side members,
said rigid frame being supported by said side members in a manner permitting relative rotation only between said lock and said frame about a pivotal axis,
said side members carrying an inner jaw and an outer jaw in a manner permitting said upright to be received between said jaws and said side members and causing said jaws to clamp said upright when a downward, oblique force is exerted upon the pivotal axis,
said inner jaw being located between and below said pivotal axis and said outer jaw when in locked position,
the improvement comprising attachment means on said side members,
said attachment means being situated between the pivotal axis and said inner jaw and said attachment means being adapted to be engaged by said hoisting mechanism,
said hoisting mechanism comprising, a stirrup, an inner jaw and an outer jaw spaced from each other and connected to said spaced plates defining a space receiving said upright post, spaced levers connected to said spaced plates and having a foot engaging stirrup fixed to one end of spaced levers and space straps connected to the end of said levers remote from said stirrup, said spaced straps being connected to said side members of said lock, said lifting mechanism comprising a hoisting mechanism having means on its lower end adapted to engage a member on said bracket, lock disabling means attached to said lock whereby said lock can be held from locking to said upright and said lock with a scaffold thereon can be lowered by means of a hoist attached to said lock.

11. A platform support adapted to be supported on an upright comprising, a scaffold bracket, said scaffold bracket comprising, scaffold lock means to slidably receive said upright to grip said upright for supporting a scaffold at a predetermined height and to slidably receive said upright for up and down movement of said scaffold, support means supporting said platform support on said scaffold lock means, mechanical jack means, connecting means connecting said mechanical jack means to said scaffold bracket for selectively raising said scaffold bracket causing said scaffold bracket to slide up said upright, a jack lever connected to said jack for operating said jack, jack lock disabling means on said mechanical jack means for disabling said mechanical jack means from gripping said upright and scaffold lock disabling means connected to said scaffold lock means including a member attached to said scaffold lock means and extending downwardly therefrom whereby said scaffold lock means can be held out of gripping engagement with said upright by a person at a substantial distance from said scaffold lock means, and flexible lifting means having gripper means thereon connected to said scaffold lock means and adapted to raise and lower said scaffol bracket when said jack lock and said scaffold lock means are disabled and held out of gripping engagement with said upright.

12. In combination, a scaffold bracket, an upright member, and restraining means supporting said scaffold bracket on said upright member, hoist means connected to said scaffold bracket for raising and lowering said scaffold bracket, and disabling means connected to said restraining means for disabling said restraining means when lowering said scaffold bracket by said hoist means, said hoist means comprises a rope hoist having a pulley at the top and a pulley at the bottom and a hook on the lower pulley, said scaffold bracket comprising a load-activated lock, means on said load-activated lock to be engaged by said hook, said hook being inclined downward and outward away from said upright member, whereby said hook may be drawn down through said load-activated lock, said hook is connected to a pulley having a pull down rope attached thereto and extending downwardly therefrom, said load-activated lock having side members, said disabling means comprising a hinged bar on said hoist means being adapted to swing to a vertical position to pass through between said side members and to move to a lateral position for engaging said side members.

13. The combination recited in claim 12 wherein said mechanical jack comprises, a lock, levers and straps connected together, said jacking means further includes means for restraining said levers to said side members so that the jaws do not bear against opposed faces of said interposed upright when levers are moved to a predetermined position.

14. The combination recited in claim 12 wherein jacking means, including a second load-activated lock, is connected to said first-mentioned load-activated lock, said second load-activated lock receiving said upright member, levers connecting said second load-activated lock to said first-mentioned load-activated lock, said jacking means further including means for restraining said levers to said side members so that the jaws do not bear against opposed faces of said upright member when said levers are moved to a predetermined position.

15. The combination recited in claim 14 wherein said hook is attached to a lower pulley and said lower pulley has two spaced side members and a rope-engaging wheel pivotally supported between said side members and a laterally-extending member pivoted between said side members, and a rope attached to said pulley for engaging a platform adapted to be supported on said scaffold bracket.

16. The combination recited in claim 15 wherein jack lock disabling means is supported on said jack lock means, said jack lock disabling means being adapted to engage said jack lever for holding said jack lock in a position whereby said jack inner jaw and said jack outer jaw are held out of gripping engagement with said upright.

17. The combination recited in claim 14 wherein the mechanical jack is connected to said scaffold lock means by connecting means on said load activated lock between said inner jaw and said means supporting said platform.

18. The combination recited in claim 14 wherein the mechanical jack comprises, a lock, a jack lever and strap means, said lock having an inner jaw and an outer jaw spaced from each other and adapted to slidably receive said upright therebetween when said jack lever is moved in a first direction, and to grip said upright when said jack lever is moved in the other direction, said lever being pivotally connected to said jack lock means, said jack inner jaw being disposed between said jack outer jaw and said pivot means and strap means connected to said lever means and to said scaffold bracket lock means between said scaffold bracket inner jaw and said support means.

19. The combination recited in claim 12 wherein a jacking mechanism is connected to said scaffold bracket, said jacking mechanism comprising a load-activated lock adapted to be supported on said upright member, levers pivoted to said load-activated lock, link means on said levers extending downward therefrom and attached to said load-activated lock, said levers having jam means thereon adapted to engage said load-activated lock deactivating said load-activated lock when said levers are swung to a predetermined position, thereby permitting said load-activated lock to move freely up or down on said upright member.

20. In combination, a scaffold bracket for use with an upright post and a lifting mechanism, said scaffold bracket being of the type employing a rigid frame for supporting a platform and a lock having side members, said rigid frame supported by said side members in a manner permitting relative rotation only between said lock and said frame about a pivotal axis, said side members carrying an inner jaw and an outer jaw in a manner permitting said upright post to be received between said jaws and said side members and causing said jaws to clamp said upright post when a downward, oblique force is exerted upon the pivotal axis, said inner jaw being located between and below said pivotal axis and said outer jaw when said lock is in the locked position, the improvement comprising attachment means on said side members, said attachment means being situated between said pivotal axis and said inner jaw and said attachment means being adapted to be engaged by a hoisting mechanism, said hoisting mechanism comprising a hoisting member having a hook and means adapted to engage said attachment means.

21. The improvement according to claim 20 wherein said rigid frame has means thereon to support said platform and said means to support said platform is disposed on the side of said upright post remote from said outer jaw.

22. The improvement recited in claim 20 wherein said attachment means comprises, spaced rigid frame members connected to said side members and extending downward therefrom, means connecting lower ends of said rigid frame members and extending therebetween and adapted to engage said upright post, a bar means connected to said lower ends of said rigid frame members and space outwardly from said upright post and adapted to be engaged by a hoisting means.

23. In combination, a scaffold bracket and a lifting mechanism, a locking mechanism and a hoisting mechanism for use with an upright post, said scaffold bracket being of the type employing a rigid frame for supporting a platform and a lock having side members, said rigid frame being supported by said side members in a manner permitting relative rotation only between said lock and said frame about a pivotal axis, said side members carrying an inner jaw and an outer jaw in a manner permitting said upright post to be received between said jaws and said side members and causing said jaws to clamp said upright post when a downward, oblique force is exerted upon said pivotal axis, said inner jaw being located between and below said pivotal axis and said outer jaw, the improvement comprising attachment means on said side members, said attachment means being situated between said pivotal axis and said inner jaw and said attachment means being adapted to be engaged by said hoisting mechanism, said hoisting mechanism comprising, a stirrup, an inner jaw and an outer jaw spaced from each other and connected to said side members defining a space receiving said upright post, spaced levers connected to said side members and having a foot engaging stirrup fixed to one end of spaced levers and spaced straps connected to the end of said spaced levers remote from said stirrup, said spaced straps being connected to said side members at said lock, said lifting mechanism comprising a hoisting mechanism having means on its lower end adapted to engage a member on said scaffold bracket.

24. In combination, a scaffold bracket and a lifting mechanism comprising, two spaced first plate-like members receiving an upright member therebetween, an outer jaw member fixed to said plate-like members and extending therebetween and engaging said upright member, an inner jaw member fixed to said plate-like members and extending therebetween, below said outer jaw member, said upright member being received between said inner jaw member and said outer jaw member, a fulcrum member fixed to said plate-like members on a side of said inner jaw member remote from said outer jaw, and means supporting a platform on said fulcrum member, two spaced second plate-like members receiving said upright member therebetween, a second outer jaw member and a second inner jaw member, said second inner jaw member and said second outer jaw member being disposed below said first-mentioned jaw members, a first lifting strap connected to one said first plate-like member at a position between said fulcrum member and said first-mentioned inner jaw member at its first end, a second lifting strap connected to said other first plate-like member between said fulcrum member and said second inner jaw member at its first end, an axle attached to said second plate-like members and extending therebetween, and disposed on the side of said second inner jaw member remote from said second outer jaw member, a first lever attached to one end of said axle, and a second lever attached to the other end of said axle, a stirrup member fixed to the second end of said levers and extending therebetween, the first end of said levers being pivoted to a second end of said lifting straps whereby said stirrup member can be moved up and down manually, thereby moving said scaffold bracket up said upright member, and a stop member connected to said first lever adapted to engage one said plate-like member holding said jaws from said upright.

25. The scaffold bracket recited in claim 24 wherein a helical spring is supported on said axle, one end of said helical spring being connected to one said second plate-like member between said second inner jaw and said axle, the second end of said helical spring engages means on said levers for urging said levers to swing upwardly.

26. The scaffold bracket recited in claim 25 wherein said helical spring has two spaced helical parts receiving said axle, each said helical part having a first end engaging one said second plate-like member and a second end engaging a member fixed to said levers, a first lever attached to one end of said axle, and a second lever attached to the other end of said axle, a stirrup member fixed to said second end of said levers and extending therebetween, the first end of said levers being pivoted to a second end of said lifting straps whereby said stirrup member can be moved up and down manually, thereby moving said scaffold bracket up said upright member, and a stop member connected to said first lever adapted to engage one said second plate-like member holding said jaws from said upright member.

27. The scaffold bracket recited in claim 26 wherein a helical spring is supported on said axle, one end of said helical spring being connected to one said second plate-like member between said second inner jaw and said axle, the second end of said helical spring engages means on said levers for urging said levers to swing upwardly.

28. The scaffold bracket recited in claim 27 wherein said helical spring has two spaced helical parts receiving said axle, each said helical part having a first end engaging one said second plate-like member and a second end engaging a member fixed to said levers and extending therebetween.

* * * * *

UNITED STATES PATENT OFFICE

CERTIFICATE OF CORRECTION

Patent No. 4,103,856 Dated August 1, 1978

Inventor(s) Henry Riblet

Figure 5:
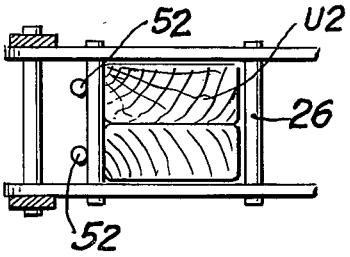
FIG. 5 is a cross-sectional view taken on line 5—5 of FIG. 1.
Figure 6:
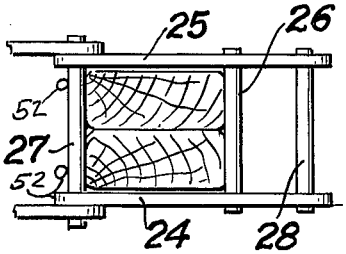
FIG. 6 is a cross-sectional view taken on line 6—6 of FIG. 1.

It is certified that error appears in the above-identified patent and that said Letters Patent are hereby corrected as shown below:

IN THE DRAWING:

The Fig. 6 should show the side plates 24 and 25 extending outward to the left like Fig. 5.

| | | |
|---|---|---|
| Column 1, | Line 18 | Cancel "and a block and tackle". |
| Column 2, | Lines 41 and 42 | Delete "and 13". |
| | Line 44 | Delete "a pivoted". |
| | Line 45 | Delete "and 13". |
| | Line 46 | Delete "and 13". |
| | Line 64 | After "spaced plates" insert --11--. |
| Column 3, | Line 16 | Change "trunnion bar" to --pivot--. |
| | Lines 17 and 19 | Change "25" to --24-- and "trunnion bar" to --pivot--. |
| | Line 22 | Change "trunnion" to --pivot-- and "completely eliminate" to --minimize--. |
| | Line 24 | Change "causes" to --is raised since-- and delete "to" and change "reassert" to --reasserts--. |
| | Lines 28 -31 | Delete "entirely". |
| | Lines 36 and 37 | Cancel "have means for attaching them to the trunnion axis" and insert --are attached to plates 24 by pivots 23--. |
| | Line 58 | Change "self acting" to --load activated--. |
| Column 4, | Line 62 | Cancel "by" should read -- up --. |

Figure 3:
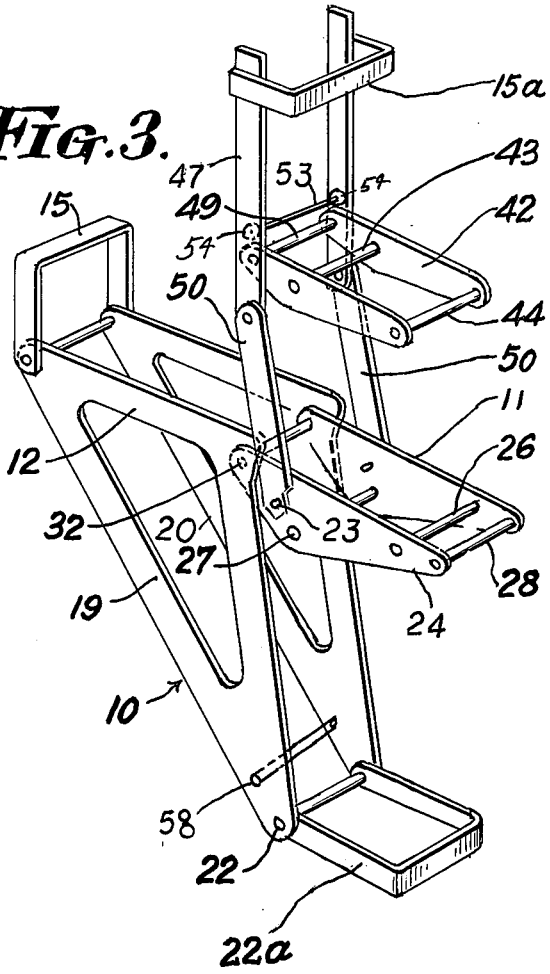
FIG. 3 is an isometric view of the lock and jacking mechanism shown in FIG. 1.

In the Drawing, Figs. 1 and 3 show the rollers 54 in contact with the side plates 42.

UNITED STATES PATENT OFFICE

CERTIFICATE OF CORRECTION

Patent No. 4,103,856 Dated August 1, 1978

Inventor(s) Henry Riblet

It is certified that error appears in the above-identified patent and that said Letters Patent are hereby corrected as shown below:

| | |
|---|---|
| Claim 1, Line 17 | After "means" insert --by connecting means--. |
| Claim 5, Line 4 | Change "connecting" to --attaching--. |
| Claim 6, Line 8 | Change "connecting" to --attaching--. |
| Claim 10, Line 33 | Change "space" to --spaced--. |
| Claim 10, Line 36 | After "said lock" insert --a lifting mechanism,-- |
| Claim 11, Line 30 | Delete "lock means" and insert --bracket--. |
| Claim 13, Lines 1 and 2 | Change "wherein said mechanical jack comprises" to --in combination with jacking means comprising--. |
| Claim 14, Lines 2 4 and 6 | Delete "load activated". |
| Lines 3 and 7 | Delete "first mentioned". |
| Claim 17, Line 2 | Change "mechanical jack" to --jacking means--. |
| Claim 18, Line 2 | Change "mechanical jack" to --jacking means--. |
| Claim 19, Lines 4, 7, 11, 12 & 14 | Delete "load activated". |
| Claim 22, Line 9 | Change "space" to --spaced--. |
| Claim 24, Line 23 | Change "below" to --above--. |

Signed and Sealed this

Eighteenth Day of September 1979

[SEAL]

Attest:

Attesting Officer

LUTRELLE F. PARKER

Acting Commissioner of Patents and Trademarks